US011845518B2

(12) United States Patent
Uozumi et al.

(10) Patent No.: US 11,845,518 B2
(45) Date of Patent: Dec. 19, 2023

(54) SMALL PLANING WATERCRAFT AND PROCESSING METHOD FOR SMALL PLANING WATERCRAFT

(71) Applicant: Kawasaki Motors, Ltd., Akashi (JP)

(72) Inventors: Yoshinobu Uozumi, Akashi (JP); Hideaki Ebisui, Akashi (JP); Kazuki Ueda, Akashi (JP)

(73) Assignee: Kawasaki Motors, Ltd., Akashi (JP)

( * ) Notice: Subject to any disclaimer, the term of this patent is extended or adjusted under 35 U.S.C. 154(b) by 9 days.

(21) Appl. No.: 17/454,845

(22) Filed: Nov. 15, 2021

(65) Prior Publication Data

US 2023/0150611 A1 May 18, 2023

(51) Int. Cl.
*B63B 11/00* (2006.01)
*B63B 79/10* (2020.01)

(52) U.S. Cl.
CPC ..... *B63B 11/00* (2013.01); *B63B 79/10* (2020.01)

(58) Field of Classification Search
CPC ..... B63B 19/00; B63B 19/08; B63B 19/12; B63B 19/14; B63B 2019/0053; B63B 79/00; B63B 79/10; B63B 79/40; B63B 11/00
USPC ..... 114/55.55, 116, 117, 201 R
See application file for complete search history.

(56) References Cited

U.S. PATENT DOCUMENTS 5,537,948 A * 7/1996 Kobayashi ..... F02B 61/045 440/89 C
5,586,922 A * 12/1996 Kobayashi ..... B63H 11/08 440/38
6,112,685 A * 9/2000 Matsuda ..... F02M 35/10013 114/55.53
6,244,916 B1 6/2001 Asakura et al.
2021/0262273 A1* 8/2021 Stranger ..... E05F 1/00

* cited by examiner

*Primary Examiner* — Daniel V Venne
(74) *Attorney, Agent, or Firm* — BURR PATENT LAW, PLLC

(57) ABSTRACT

A small planing watercraft includes: a body including a storage box and a lid, the storage box including an opening, the lid releasably closing the opening; an opening and closing sensor detecting opening and closing of the lid; and processing circuitry determining whether the lid is open based on a result of detection of the opening and closing sensor, and, when determining that the lid is open, outputting a signal indicating that the lid is open.

14 Claims, 7 Drawing Sheets

SMALL PLANING WATERCRAFT AND PROCESSING METHOD FOR SMALL PLANING WATERCRAFT

BACKGROUND OF THE INVENTION

Field of the Invention

The present disclosure relates to small planing watercrafts and processing methods for small planing watercrafts.

Description of the Background Art

U.S. Pat. No. 6,244,916 B1 discloses a small planing watercraft including a storage box and a hatch cover covering an opening of the storage box.

SUMMARY

A small planing watercraft according to one aspect is a small planing watercraft including: a body including a storage box and a lid, the storage box including an opening, the lid releasably closing the opening; an opening and closing sensor detecting opening and closing of the lid; and processing circuitry determining whether the lid is open based on a result of detection of the opening and closing sensor, and, when determining that the lid is open, outputting a signal indicating that the lid is open.

According to the small planing watercraft, notification to an operator, control of travel, or the like can be provided based on the signal indicating that the lid is open.

A small planing watercraft according to another aspect is a processing method for a small planing watercraft including a storage box and a lid, the storage box including an opening, the lid releasably closing the opening, the processing method including: detecting opening and closing of the lid; determining whether the lid is open based on a result of detection; and, when determining that the lid is open, setting a travel mode to a second travel mode in which output is suppressed relative to a first travel mode.

Ingress of water into the storage box and a fall of an object out of the storage box are thus suppressed.

A small planing watercraft according to yet another aspect is a processing method for a small planing watercraft including a storage box and a lid, the storage box including an opening, the lid releasably closing the opening, the processing method including: detecting opening and closing of the lid; determining whether the lid is open based on a result of detection; and, when determining that the lid is open, providing notification that the lid is open.

The operator can thus be notified that the lid is open.

These and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

A small planing watercraft and a processing method for the small planing watercraft in a first embodiment will be described below.

<Overall Configuration>

Figure 1:
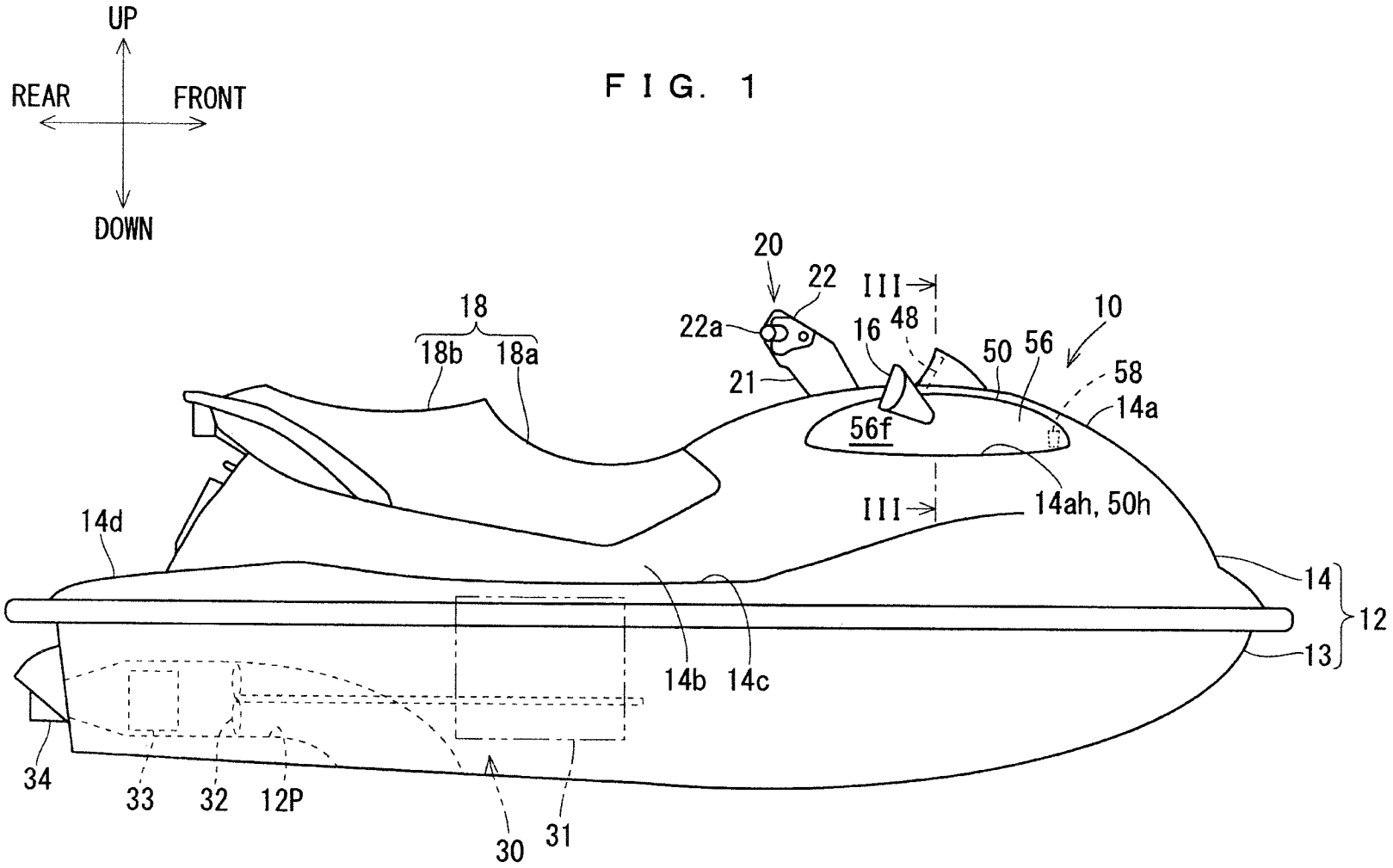
FIG. 1 is a side view illustrating a small planing watercraft in a first embodiment.
Figure 2:
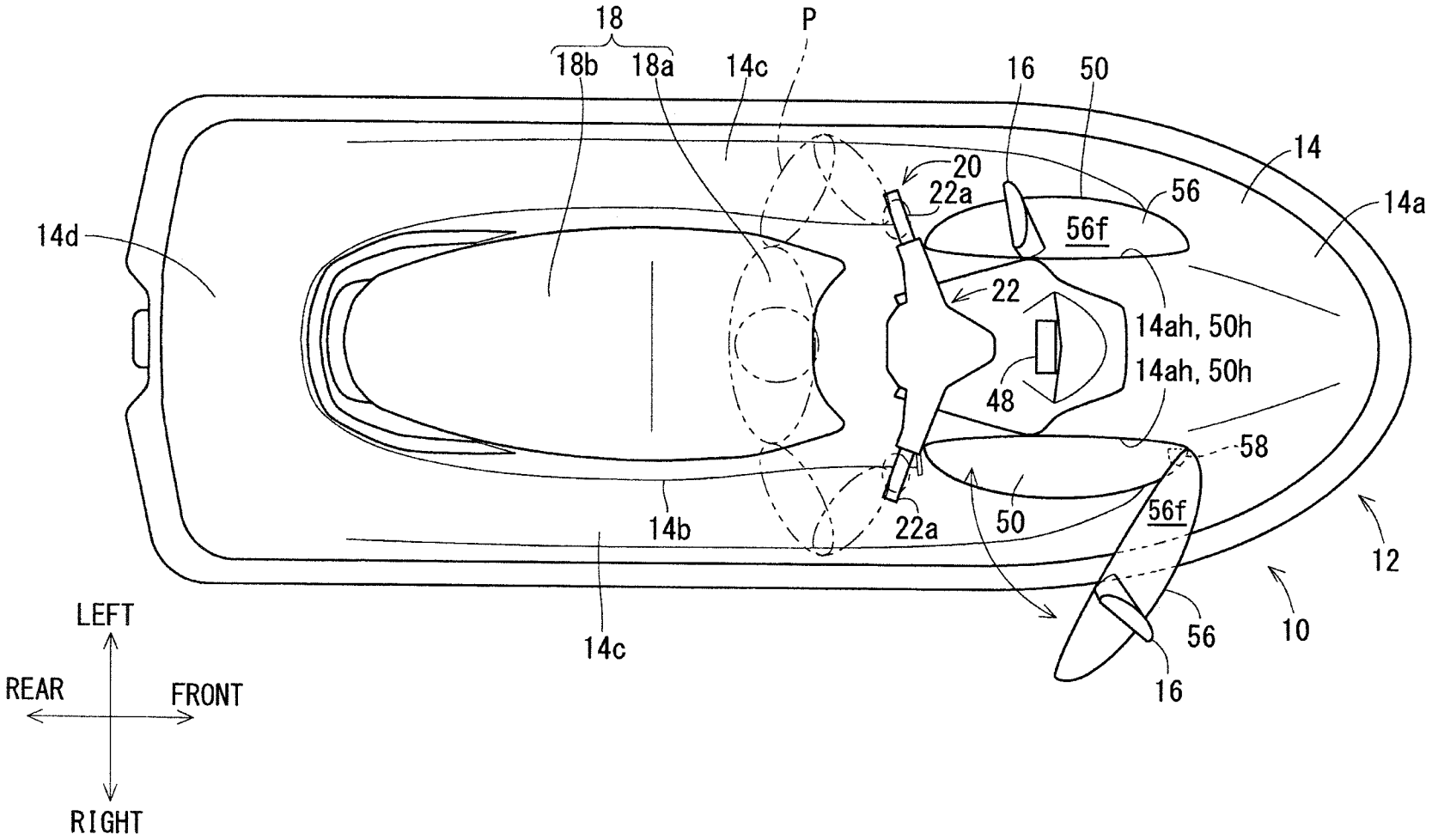
FIG. 2 is a plan view illustrating the small planing watercraft.

An overall configuration of a small planing watercraft 10 will be described. FIG. 1 is a side view illustrating the small planing watercraft 10. FIG. 2 is a plan view illustrating the small planing watercraft 10. An operator P on board the small planing watercraft 10 is illustrated in FIG. 2. The small planing watercraft 10 is a boat raised by lift when moving forward, and planing to slide across a water surface. The small planing watercraft 10 may have a size for a single person, two to four people, or five or more people, for example. One example of the small planing watercraft 10 is a personal watercraft (PWC). The small planing watercraft 10 may be a motorboat. An example in which the small planing watercraft 10 is the PWC will be described in the present embodiment.

The small planing watercraft 10 includes a body 12, a seat 18, and a handle device 20. The body 12 is a structure of the small planing watercraft 10 having a space to generate buoyancy in water. For example, the body 12 includes a hull 13 and a deck 14. The hull 13 is a container-like structure closing on a lower side and opening on an upper side. The deck 14 covers an opening on the upper side of the hull 13. The seat 18 is disposed on the deck 14. The operator P is seated on the seat 18. The handle device 20 is disposed above the body 12 and forward of the seat 18. The operator P operates the handle device 20 in a state of being seated on the seat 18. With reference to a posture of the operator operating the small planing watercraft 10 in a planing state, a side forward of the operator is a front side, and a side rearward of the operator is a rear side. A left side and a right side are determined with reference to a state of the operator facing forward. A side of the hull 13 is a lower side, and a side of the deck 14 is an upper side.

The deck 14 includes a front 14*a*, a central protrusion 14*b*, side floors 14*c*, and a rear floor 14*d*. The front 14*a* covers a front portion of the opening on the upper side of the hull 13. The front 14*a* is curved to be convex. When viewed from one side along the width, the front 14*a* gradually slopes upward from a front end portion of the hull 13, reaches the top near the handle device 20, gradually slopes downward from the top, and is connected to the seat 18. When viewed from the front, the front 14*a* gradually slopes upward from a right or left portion toward a central portion along the width of the hull 13. The central protrusion 14*b* extends rearward from a central portion along the width of a rear end of the front 14*a*. The central protrusion 14*b* has a smaller width than the deck 14. The side floors 14*c* extend outward along the width of the central protrusion 14*b*. A rear end of the central protrusion 14*b* is located forward of a rear end of the deck 14. The rear floor 14*d* extends behind the central protrusion 14*b* of the deck 14. The central protrusion 14*b* protrudes above the side floors 14*c* and the rear floor 14*d*.

The body 12 is a body turnable while rolling. That is to say, the opening on the upper side of the hull 13 is covered with the deck 14. Ingress of water into the hull 13 is thus less likely to occur when the hull 13 rolls compared with a case where the deck 14 is not provided. The body 12 is thus turnable while rolling with ingress of water being prevented. Turning while rolling is, for example, turning to the right or left while inclining at an angle of more than 30° about a roll axis. Turning while inclining at an angle of 30° may or may not be considered as turning while rolling.

The seat 18 is supported by an upper portion of the central protrusion 14*b*. The operator P is seated on the seat 18 to straddle the seat 18. The seat 18 is longer in a fore-aft direction, for example. The seat 18 includes a seat front portion 18*a* and a seat rear portion 18*b* located rearward of the seat front portion 18*a*, for example. The seat front portion 18*a* is lower than the seat rear portion 18*b*. From among users, the operator P is seated on the seat front portion 18*a*, and a passenger is seated on the seat rear portion 18*b*.

The small planing watercraft 10 includes a propulsion device 30. The propulsion device 30 is a device to propel the small planing watercraft 10. The propulsion device 30 includes a travel drive source 31, an impeller 32, a stator vane 33, and a nozzle 34, for example.

The travel drive source 31 is a drive source generating propulsion power. In the present embodiment, the travel drive source 31 rotationally drives the impeller 32. The travel drive source 31 is only required to generate propulsion for the small planing watercraft 10. For example, the travel drive source 31 may be an internal combustion engine generating rotary drive force through fuel combustion or an electrical motor generating the rotary drive force using electrical energy. Assume that the travel drive source 31 is the internal combustion engine in the present embodiment. The travel drive source 31 is disposed within the body 12, for example. The body 12 has a water flow path 12P to take in water outside the body 12 and jet water rearward. The impeller 32 is disposed within the flow path 12P. The travel drive source 31 rotationally drives the impeller 32 to allow water within the flow path 12P to flow rearward of the impeller 32. The stator vane 33 is disposed rearward of the impeller 32 within the flow path 12P. A swirling flow behind the impeller 32 is rectified by the stator vane 33, and is allowed to flow further rearward. The nozzle 34 is disposed at a rear end portion of the flow path 12P. Water flowing from the impeller 32 through the stator vane 33 is compressed by the nozzle 34, and jetted rearward of the body 12. Forward propulsion for the small planing watercraft 10 can thus be obtained.

The propulsion device of the small planing watercraft 10 is not limited to that in the above-mentioned example. For example, the small planing watercraft 10 may be propelled by rotating a screw outside the body 12.

The handle device 20 includes a columnar part 21 extending upward from the deck 14 and a handle 22. The handle 22 includes left and right handle grips 22*a* extending both to the left and to the right from an upper end portion of the columnar part 21. A central portion along the width of the handle 22 is supported by the upper end portion of the columnar part 21, so that the handle 22 is supported at a position above the body 12. The operator P can operate the small planing watercraft 10 while grasping the left and right handle grips 22*a* in a state of being seated on the seat front portion 18*a*.

The small planing watercraft 10 includes left and right auxiliary mirrors 16. The left and right auxiliary mirrors 16 are disposed forward of the seat 18. For example, the left and right auxiliary mirrors 16 protrude outward along the width from the front 14*a* at a position forward of the left and right handle grips 22*a*. The operator P seated on the seat 18 can see a rearward range reflected in reflecting surfaces of the auxiliary mirrors 16 by viewing the reflecting surfaces while facing forward. One or both of the auxiliary mirrors 16 may be omitted.

The small planing watercraft 10 includes a display device 48. The display device 48 is disposed forward of the seat 18. The display device 48 is located to be recognizable by the operator seated on the seat front portion 18*a* while grasping the pair of handle grips 22*a*, for example. For example, the display device 48 is attached to the front 14*a* to be located forward of the handle device 20 and at the center along the width of the deck 14. The display device 48 may be attached to the handle device 20. The display device 48 may be omitted. Examples of the display device 48 include a liquid crystal display and an organic electro-luminescence (EL) display. The display device 48 displays visual information for people on board including the operator. The operator can acquire the visual information displayed by the display device 48 by viewing the display device 48 while operating the small planing watercraft 10.

<Storage Box and Lid>

Figure 3:
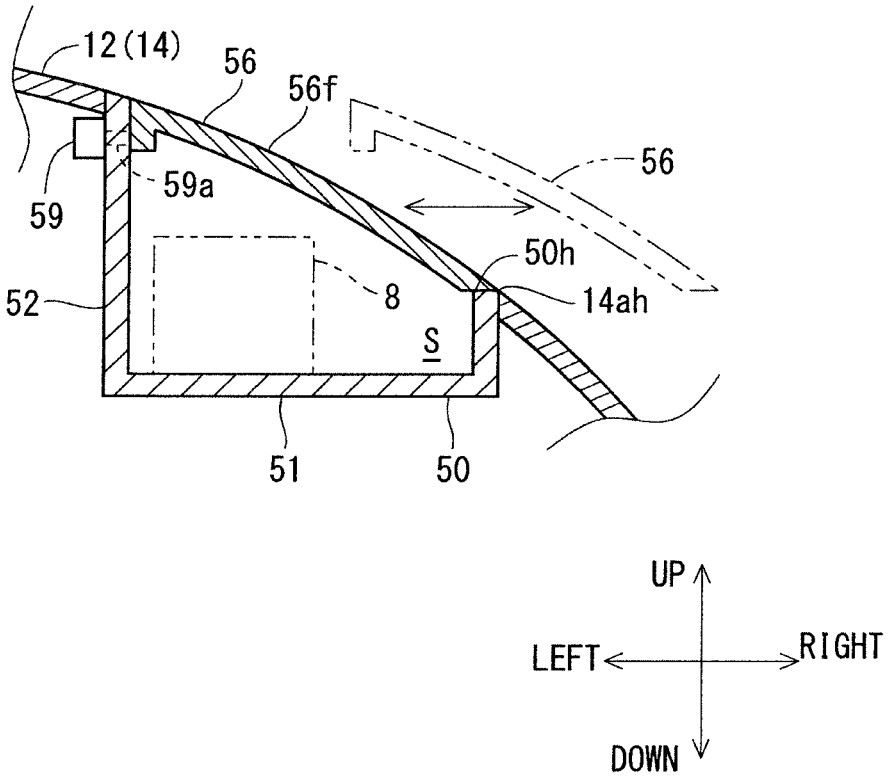
FIG. 3 is a partial cross-sectional view taken along the line of FIG. 1.

FIG. 3 is a partial cross-sectional view taken along the line of FIG. 1. As illustrated in FIGS. 1 to 3, the body 12 includes a storage box 50 and a lid 56. The storage box 50 has an opening 50*h*, and can store an object 8. The lid 56 releasably closes the above-mentioned opening 50*h*. In the present embodiment, the body 12 includes storage boxes 50 and lids 56. More specifically, the body 12 includes left and right storage boxes 50 and left and right lids 56.

In the present embodiment, the two storage boxes 50 are disposed in opposite side portions of the front 14*a*. That is to say, the side portions of the front 14*a* have openings 14*ah*. The openings 14*ah* are located in intermediate portions in the fore-aft direction of the front 14*a* to be closer to the top and to the center along the width of the body 12, for example. In the present embodiment, portions of the front 14*a* supporting the auxiliary mirrors 16 have the openings 14*ah*. The openings 14*ah* are longer in the fore-aft direction, for example.

Each of the storage boxes 50 includes a bottom 51 and a side wall 52. The bottom 51 is a plate-like portion spanning a region of each of the openings 14*ah* when viewed from above. The side wall 52 protrudes upward from the periphery of the bottom 51 to form a storage space S above the bottom 51. A portion of the side wall 52 located to be closer to the center along the width of the body 12 protrudes more than a portion of the side wall 52 located outward along the width of the body 12. Portions of the side wall 52 located on opposite sides in the fore-aft direction of the body 12 each gradually increasingly protrude with decreasing distance from the center along the width of the body 12. The opening 50*h* having the shape and the size corresponding to those of the above-mentioned opening 14*ah* is formed on a side of the side wall 52 opposite the bottom 51.

The storage box 50 is attached to the body 12 with the bottom 51 being disposed within the front 14*a* in a horizontal posture and with the opening 50*h* matching the opening 14*ah*. The storage box 50 is attached by a screwing, welding, or fitting structure, for example. The storage space S surrounded by the bottom 51 and the side wall 52 is thus formed inside the opening 14*ah* of the front 14*a*.

The opening 50*h* of the storage box 50 is located forward of the handle 22 when the storage box 50 is attached to the deck 14. The operator P seated on the seat 18 can thus easily access the interior of the storage box 50 by reaching forward of the handle 22. The operator P seated on the seat 18 can also easily observe a state of the opening 50*h* of the storage box 50 by looking forward of the handle 22.

A portion of the front 14*a* where the storage box 50 is provided gradually slopes upward toward the center along the width of the body 12. The openings 14*ah* and 50*h* thus open orthogonally to an up-down direction. In the present embodiment, the opening 50*h* opens to one side from the center along the width of the body 12. It can be said that the opening 50*h* opens when viewed from outside along the width of the body 12.

When the opening 50*h* opens orthogonally to the up-down direction, it is easy to observe the interior of the storage box 50 and to take an object in and out of the storage box 50. On the other hand, when the opening 50*h* remains open, ingress of water into the storage box 50 is likely to occur. Furthermore, the object 8 inside the storage box 50 is likely to fall out. In particular, when the opening 50*h* opens outward along the width of the body 12, ingress of water into the storage box 50 is likely to occur due to waves made outside the small planing watercraft 10 during planing of the small planing watercraft 10.

The lid 56 is shaped to be able to close the opening 50*h*. That is to say, an outer peripheral edge of the lid 56 is shaped along an edge of the opening 50*h*. An outer surface of the lid 56 spans a region where the opening 50*h* is closed. An outer surface 56*f* of the lid 56 serves as a portion of an outer surface of the body 12 when the lid 56 is closed. For example, the outer surface 56*f* is contiguous with an outer surface of the front 14*a* around the opening 14*ah* with or without a step therebetween. The outer surface of the lid 56 thus serves as a portion of the outer surface of the front 14*a* to prevent ingress of water into the body 12. The outer surface 56*f* may be curved to be convex to match the outer surface of the front 14*a* around the opening 14*ah*. The lid 56 is connected to an edge of the opening 14*ah* by a hinge 58. For example, a front end portion of the lid 56 is connected to a front end portion of the edge of the opening 14*ah* by the hinge 58. The hinge 58 may include an opening and closing shaft along the up-down direction. In this case, the lid 56 can swing around an axis along the up-down direction of the hinge 58. The lid 56 extends rearward from the hinge 58 to close the opening 50*h*. The lid 56 extends outward along the width of the body 12 or obliquely rearward from the hinge 58 to open the opening 50*h*.

The opening of the storage box 50 may be the opening 14*ah* of the front 14*a*. The storage box 50 and the front 14*a* may integrally be molded using the same material.

The small planing watercraft 10 includes an opening and closing sensor 59 detecting opening and closing of the lid 56. The opening and closing sensor 59 may be a contact sensor detecting contact between the lid 56 and the opening 50*h*, for example. That is to say, the outer peripheral edge of the lid 56 is in contact with the edge of the opening 50*h* when the lid 56 closes the opening 50*h*. The opening and closing sensor 59 may be a contact sensor including an operational part 59*a*, and, upon pressing of the operational part 59*a*, a point of contact may be switched from an open state to a closed state or vice versa, for example. The opening and closing sensor 59 is assembled to the opening 50*h* with the above-mentioned operational part 59*a* protruding from the edge of the opening 50*h*. The operational part 59*a* protrudes from the opening 50*h* due to an elastic force of a spring and the like when the lid 56 is open. The operational part 59*a* is pressed by the outer peripheral edge of the lid 56 when the lid 56 is closed to be in contact with the opening 50*h*. The operational part 59*a* returns to the protruding state by the elastic force of the spring and the like when the lid 56 is opened. The point of contact in the opening and closing sensor 59 is switched between the open state and the closed state depending on whether the operational part 59*a* is in the protruding state or a retracted state. A detection signal is output from the opening and closing sensor 59 in response to the open or closed state. The contact sensor may be a sensor referred to as a push switch or a microswitch.

<Block Diagram>

Figure 4:
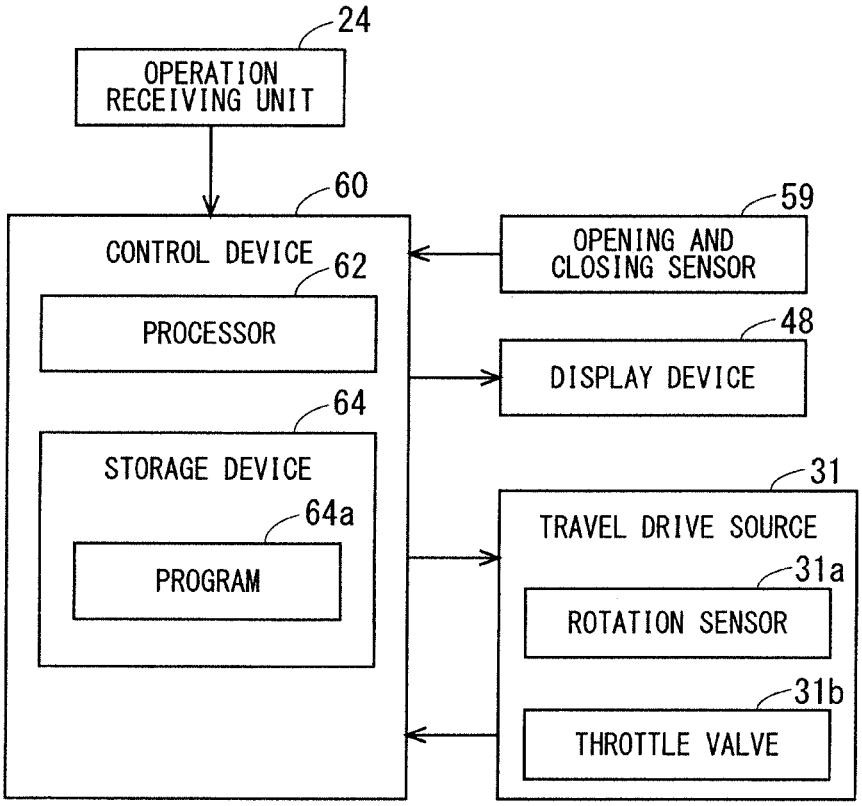
FIG. 4 is a block diagram showing an electrical configuration of the small planing watercraft.

FIG. 4 is a block diagram showing an electrical configuration of the small planing watercraft 10. The small planing watercraft 10 includes a control device 60. The control device 60 is a microcomputer including a processor 62, a storage device 64, and the like. The control device 60 is one example of processing circuitry. The processor 62 is an electrical circuit including an arithmetic circuit, and is a central processing unit (CPU), for example. The processor 62 may include one or more processor cores. Processing of the control device 60 may be achieved by one or more processors 62 of the control device 60, or may be achieved by cooperative processing of control devices. The storage device 64 is nonvolatile memory, such as flash memory. A software program 64*a* is stored in the storage device 64. The processor 62 performs arithmetic operation according to procedures described in the program 64*a* to perform control described below.

The control device 60 is connected to various sensors and a drive control component of an operation receiving unit 24, the opening and closing sensor 59, the display device 48, and the travel drive source 31.

The operation receiving unit 24 receives input operation relating to operation from the operator, and provides a signal in response to the received input operation to the control device 60. The operation receiving unit 24 includes a starter switch to start the travel drive source 31 as the internal combustion engine, for example.

The opening and closing sensor 59 detects the open or closed state of the lid 56, and provides the detection signal to the control device 60.

The display device 48 performs display according to display control performed by the control device 60.

The travel drive source 31 includes a rotation sensor 31*a* and a throttle valve 31*b*, for example. The rotation sensor 31*a* is a sensor detecting rpm of the travel drive source 31 to rotate the impeller 32. The rotation sensor 31*a* provides a detection signal to the control device 60. In this example, the rotation sensor 31*a* detects a crank angle of the travel drive source 31 to detect rpm of the travel drive source 31. In response to rpm of the travel drive source 31, the impeller 32 is rotated to generate propulsion. With an increase in rpm of the impeller 32, the small planing watercraft 10 increases in speed, and can be in the planing state. Whether the small planing watercraft 10 is in the planing state can thus be determined based on output of detection of the rotation sensor 31*a*.

The throttle valve 31*b* is a valve adjusting a quantity of an air-fuel mixture into the travel drive source 31. The control device 60 adjusts a degree of opening of the throttle valve 31*b*. By adjusting the quantity of the air-fuel mixture into the travel drive source 31, output of the travel drive source 31 can be adjusted. For example, when an accelerator provided to the handle 22 is operated, a signal in response to the operation is provided to the control device 60. The control device 60 controls the degree of opening of the throttle valve 31*b* in response to the operation performed on the accelerator. As will be described below, the degree of opening of the throttle valve 31*b* is sometimes restricted regardless of operation performed on the accelerator.

<Example of Display of Display Device>

Figure 5:
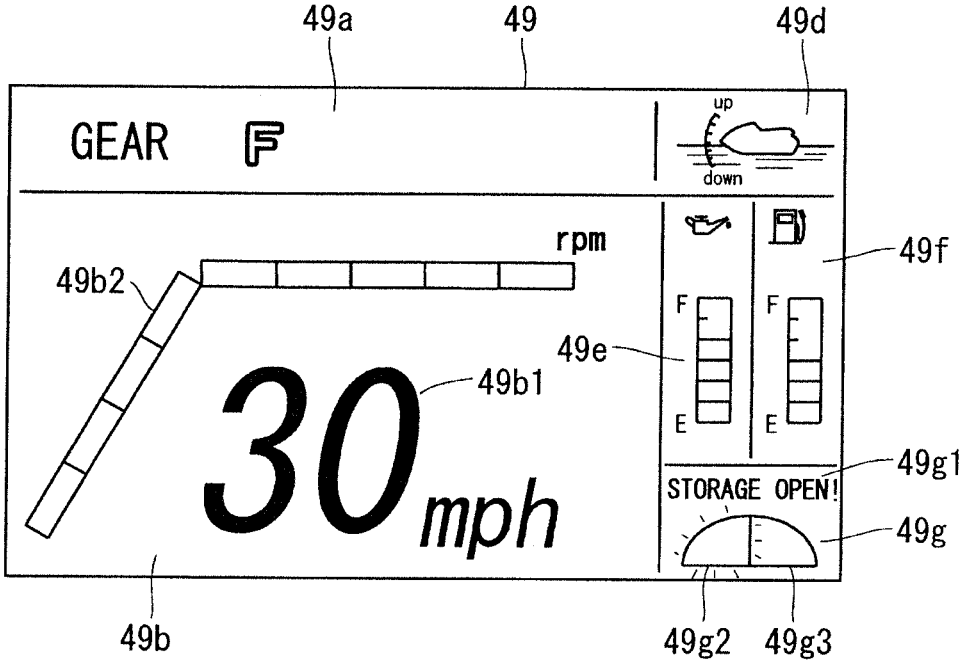
FIG. 5 illustrates an example of display of a display device.

FIG. 5 illustrates an example of display of the display device 48. The display device 48 displays information to provide notification that the lid 56 is open in response to a control command from the control device 60. In this respect, the display device 48 is one example of a notification device providing notification that the lid 56 is open.

For example, a display screen 49 of the display device 48 includes a gear position display region 49*a*, a travel information display region 49*b*, a trim angle display region 49*d*, an oil level display region 49*e*, a fuel level display region 49*f*, and a lid open state display region 49*g*. In addition to the opening and closing sensor 59 and the rotation sensor 31*a* described above, a speed sensor, a trim angle detection sensor, a fuel level detection sensor, an oil level detection sensor, and a lever or a switch for rearward movement or a stop are connected to the control device 60. The control device 60 can thus generate a signal to display each of the above-mentioned regions.

An example of the layout of the regions of the display screen 49 is as follows. The travel information display region 49*b* is the largest region expanding leftward and downward from a central portion of the display screen 49. Speed information 49*b*1 and engine rpm information 49*b*2 are displayed in the travel information display region 49*b*. The gear position display region 49*a* is located above the travel information display region 49*b* of the display screen 49. Information indicating any of forward movement, rearward movement, and a stop is displayed in the gear position display region 49*a*. The trim angle display region 49*d* is provided to the right of the gear position display region 49*a*. Information indicating a trim angle of the body 12 is displayed in the trim angle display region 49*d*. The oil level display region 49*e* and the fuel level display region 49*f* are displayed to the right of the travel information display region 49*b*. A level of lubricating oil of the internal combustion engine is displayed in the oil level display region 49*e*, and a level of fuel of the internal combustion engine is displayed in the fuel level display region 49*f*.

The lid open state display region 49*g* is located below the oil level display region 49*e*. Lid open state warning representation 49*g*1, left open state identification representation 49*g*2, and right open state identification representation 49*g*3 are displayed in the lid open state display region 49*g*. The lid open state warning representation 49*g*1 is representation to provide notification that the lid 56 is open. The lid open state warning representation 49*g*1 is, for example, characters "STRAGE OPEN!". The lid open state warning representation 49*g*1 may be a graphic, a symbol, or the like indicating that the lid 56 is open. By causing the information to blink or be lit, notification that the lid 56 is open is visually provided.

The left open state identification representation 49*g*2 is representation to provide notification that the left lid 56 is open after identification thereof. The right open state identification representation 49*g*3 is representation to provide notification that the right lid 56 is open after identification thereof. The left open state identification representation 49*g*2 is located to the left of the right open state identification representation 49*g*3, and the right open state identification representation 49*g*3 is located to the right of the left open state identification representation 49*g*2. By causing one or both of the left open state identification representation 49*g*2 and the right open state identification representation 49*g*3 to be lit or blink, opening of one or both of the left lid 56 and the right lid 56 is recognizable from a relative positional relationship between the representation 49*g*2 and the representation 49*g*3. The left open state identification representation 49*g*2 and the right open state identification representation 49*g*3 may each be another type of representation, such as characters and a graphic.

The layout and sizes of the regions of the display screen 49 are not limited to those in the above-mentioned example, and may be any layout and any sizes. At least one of the lid open state warning representation 49*g*1, the left open state identification representation 49*g*2, and the right open state identification representation 49*g*3 may be displayed by a light emitting display device, such as a light emitting diode and an electric bulb.

<Example of Processing>

Figure 6:
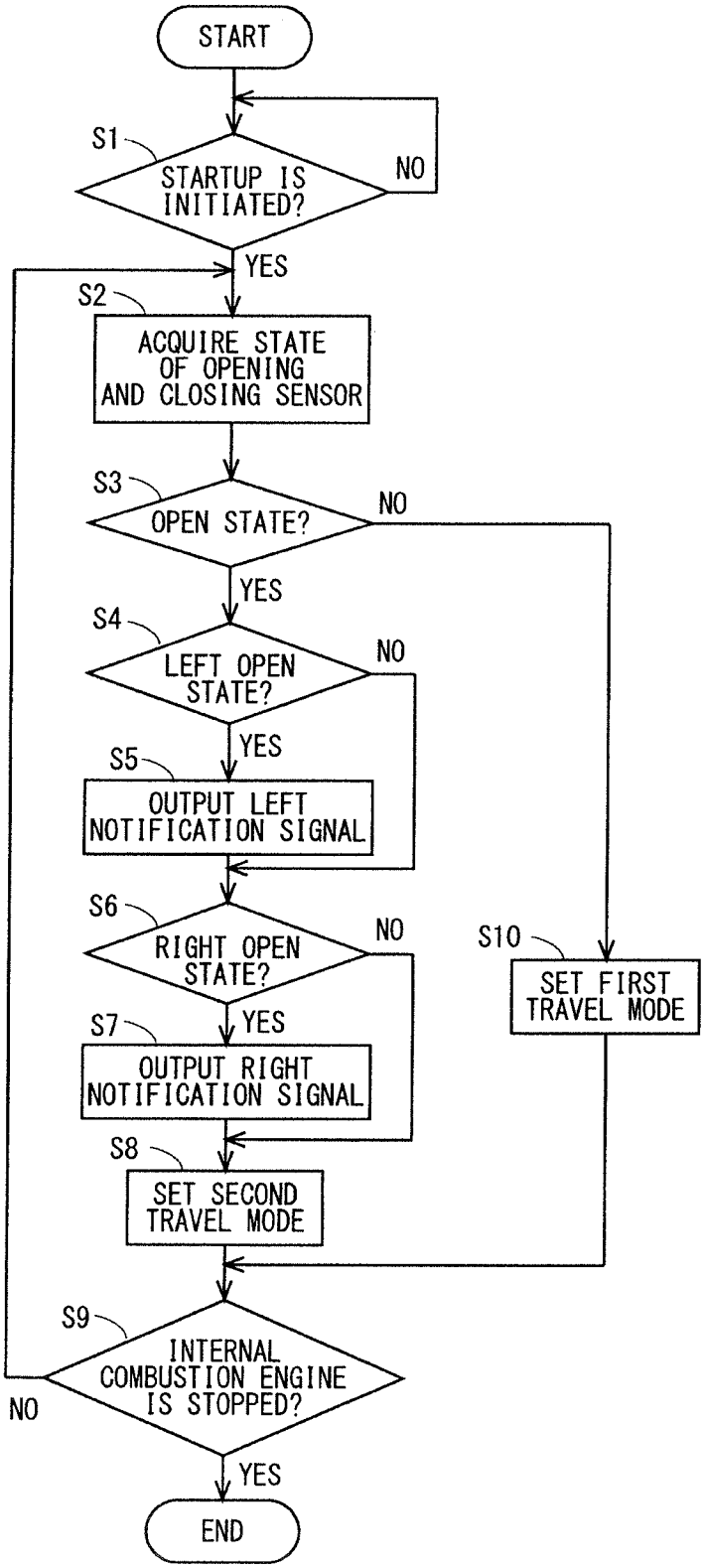
FIG. 6 is a flowchart showing an example of processing of a control device.

FIG. 6 is a flowchart showing an example of processing of the control device 60. The processing is performed in parallel with or in quasi-parallel with processing performed by the control device 60 for travel of the small planing watercraft 10, for example.

As shown in step S1, whether startup of the travel drive source 31 is initiated is determined. For example, due to operation to turn on a main switch and an ignition operation performed by the operator P, a starter motor of the travel drive source is rotated, and a crankshaft of the travel drive source 31 is rotated. With rotation of the crankshaft, the air-fuel mixture is taken into a combustion chamber of the travel drive source 31, and the air-fuel mixture in the combustion chamber is ignited to initiate startup of the travel drive source 31. The control device 60 compares rpm of the travel drive source 31 with predetermined reference rpm based on output of detection of the rotation sensor 31*a* in response to rotation of the crankshaft. The reference rpm is set to be smaller than idling rpm of the internal combustion engine as the travel drive source 31, for example. It is determined that the travel drive source 31 is started when the detected rpm exceeds the reference rpm. When the detected rpm is the same as the reference rpm, it may or may not be determined that the travel drive source 31 is started. Processing in step S1 is repeated when it is determined that the travel drive source 31 is not started. Processing proceeds to step S2 when it is determined that the travel drive source 31 is started.

In step S2, a state of the opening and closing sensor 59 is acquired based on a result of detection in response to the detection signal from the opening and closing sensor 59. When the lid 56 is open, the point of contact in the opening and closing sensor 59 is opened, and an off signal is input, and, when the lid 56 is closed, the point of contact in the opening and closing sensor 59 is closed, and an on signal is input, for example. In a case where the lid 56 is provided in each of left and right side portions of the body 12, a state of each of left and right opening and closing sensors 59 corresponding to the left and right lids 56 is acquired.

In next step S3, whether the lid 56 is open is determined based on the result of detection of the opening and closing sensor 59. In a case where the lid 56 is provided in each of the left and right side portions of the body 12, whether at least one of the left and right lids 56 is open is determined. Processing proceeds to step S4 when it is determined that the lid 56 is open, and proceeds to step S10 when it is determined that the lid 56 is not open. For example, a signal output from a determination circuit as the processing circuitry of the control device to another circuit, such as a register, for next processing when it is determined that the lid 56 is open in step S3 can be understood as one example of an output signal indicating that the lid 56 is open.

When processing proceeds to step S4, whether the left lid 56 is open is determined. Processing proceeds to step S5 when it is determined that the left lid 56 is open, and proceeds to step S6 while skipping step S5 when it is determined that the left lid 56 is not open.

In step S5, a left notification signal is output as a signal indicating that the left lid 56 is open. The left notification signal is provided to the display device 48. The display device 48 displays the lid open state warning representation 49*g*1 and the left open state identification representation 49*g*2 so that they are lit or blink in response to the left notification signal.

In next step S6, whether the right lid 56 is open is determined. Processing proceeds to step S7 when it is determined that the right lid 56 is open, and proceeds to step S8 while skipping step S7 when it is determined that the right lid 56 is not open.

In step S7, a right notification signal is output as a signal indicating that the right lid 56 is open. The right notification signal is provided to the display device 48. The display device 48 displays the lid open state warning representation 49*g*1 and the right open state identification representation 49*g*3 so that they are lit or blink in response to the right notification signal. One or more of the lids 56 that are open are identified, and notification that the identified lids 56 are open is provided in steps S4 to S7.

In next step S8, the control device 60 sets a travel mode of the small planing watercraft 10 to a second travel mode. That is to say, when it is determined that the lid 56 is open in step S3, processing in step S8 is performed after processing in steps S4 to S7 is performed, and, as a result, the travel mode is set to the second travel mode. On the other hand, when it is determined that the lid 56 is not open in step S3, processing proceeds to step S10, and the travel mode of the small planing watercraft 10 is set to a first travel mode.

The first travel mode and the second travel mode are modes in which output of the travel drive source 31 that can affect the speed of the small planing watercraft 10 is changed. Output of the travel drive source 31 in the second travel mode is suppressed relative to output of the travel drive source 31 in the first travel mode. Output of the travel drive source 31 can be evaluated by rpm of the travel drive source 31, for example. Thus, the first travel mode may be a mode in which maximum rpm of the travel drive source 31 is not restricted, and the second travel mode may be a mode in which maximum rpm of the travel drive source 31 is restricted, for example. In this case, in the first travel mode, the control device 60 adjusts the degree of opening of the throttle valve 31*b* in response to operation of a throttle to control propulsion for the travel drive source 31, for example. The small planing watercraft 10 can thus travel in response to original propulsion for the travel drive source 31, and, for example, can plane. In the second travel mode, the control device 60 adjusts the degree of opening of the throttle valve 31*b* in response to operation of the throttle to control propulsion for the travel drive source 31, for example. In this case, the control device 60 determines whether rpm of the travel drive source 31 has exceeded predetermined maximum rpm based on a result of detection of the rotation sensor 31*a*, and, when a result of determination is affirmative, maintains or reduces the degree of opening of the throttle valve 31*b* regardless of operation of the throttle. When the result of determination is negative, the control device 60 controls the degree of opening of the throttle valve 31*b* in response to operation of the throttle. When rpm of the travel drive source 31 is the same as the maximum rpm, the result of determination may be affirmative or negative. Output of the travel drive source 31 in the second travel mode is thus suppressed relative to output of the travel drive source 31 in the first travel mode.

The above-mentioned maximum rpm is only required to be set as rpm in response to a reference speed of the small planing watercraft 10, for example. The reference speed may be set in a range of 0 km/h to 10 km/h, for example. The reference speed may be set in a range in which the small planing watercraft 10 cannot plane. Rpm in response to the reference speed can theoretically and experimentally be determined in response to the shape and the weight of the small planing watercraft 10, the properties of the propulsion device, and the like. Suppression of output of the travel drive source 31 in the second travel mode is not required to be controlled in response to rpm of the travel drive source 31. For example, restriction processing to maintain or reduce the degree of opening of the throttle valve 31*b* regardless of operation of the throttle may be performed when the speed of the small planing watercraft 10 has exceeded the reference speed based on output of the speed sensor of the small planing watercraft 10. When the speed of the small planing watercraft 10 is the same as the reference speed, the restriction processing may or may not be performed.

The maximum rpm of the travel drive source 31 may be restricted also in the first travel mode. In this case, the maximum rpm in the second travel mode is set to have a smaller value than the maximum rpm in the first travel mode. A maximum degree of opening of the throttle valve 31*b* in the second travel mode may be restricted to have a smaller value than the maximum degree of opening of the throttle valve 31*b* in the first travel mode not based on a detected value of rpm of the travel drive source 31 or the speed of the small planing watercraft 10.

In the first travel mode, the lid 56 is closed, so that the object 8 inside the storage box 50 is less likely to fall out even if the small planing watercraft 10 rolls. Furthermore, ingress of water into the storage box 50 is less likely to occur even if waves or wave splashes are made around the small planing watercraft 10. In the second travel mode, output of the travel drive source 31 is suppressed, so that the small planing watercraft 10 is less likely to roll, and waves or wave splashes are less likely to be made around the small planing watercraft 10. A fall of the object 8 inside the storage box 50 and ingress of water into the storage box 50 are thus prevented.

Processing proceeds to step S9 after processing in step S8 and processing in step S10 are performed. The internal combustion engine is stopped by operation to stop operation (e.g., kill switch operation) performed by the operator. In step S9, whether the travel drive source 31 as the internal combustion engine is stopped is determined. For example, the control device 60 determines whether the travel drive source 31 is stopped based on rpm of the travel drive source 31 based on the result of detection of the rotation sensor 31*a*. Processing returns to step S2 to repeat processing in and after step S2 when it is determined that the travel drive source 31 is not stopped. Processing to set the travel mode to the second travel mode when it is determined that the lid 56 is open and set the travel mode to the first travel mode when it is determined that the lid 56 is not open is thus repeated. Processing ends when it is determined that the travel drive source 31 is stopped in step S9.

According to the small planing watercraft 10 having a configuration as described above or the processing method for the small planing watercraft 10, the notification signal indicating that the lid 56 is open is output when it is determined that the lid 56 is open. Notification to the operator P, control of travel, or the like can thus be provided based on the signal indicating that the lid 56 is open. Planing of the small planing watercraft 10 with the lid 56 being open, which can cause a fall of the object 8 inside the storage box 50 in water and difficult retrieval thereof, and ingress of water into the storage box 50, is thus less likely to occur.

The display device 48 is caused to provide notification that the lid 56 is open when it is determined that the lid 56 is open. A user, such as the operator P, can thus easily know that the lid 56 is open, and take measures, for example, to close the lid 56.

One or more of the lids 56 that are open are identified, and the display device 48 is caused to provide notification that the identified lids 56 are open. The user, such as the operator P, can thus easily know the one or more of the lids 56 that are open, and close the lids 56 to be closed.

The travel mode of the small planing watercraft 10 is switchable between the first travel mode and the second travel mode, and is set to the second travel mode when it is determined that the lid 56 is open. The small planing watercraft 10 can thus travel with output being suppressed as defined in the second travel mode when the lid 56 is open. Ingress of water into the storage box 50 and a fall of the object 8 out of the storage box 50 are thus suppressed. Furthermore, a roll and a pitch of the small planing watercraft 10 with the lid 56 being open is prevented. In contrast, when the lid 56 is closed, the small planing watercraft 10 can travel using original propulsion for the travel drive source 31.

When it is determined that the lid 56 is open, the display device 48 is caused to provide notification that the lid 56 is open, and the travel mode is set to the second travel mode, so that the user, such as the operator P, can understand that the travel mode is set to the second travel mode in which output is suppressed because the lid 56 is open. The user can thus easily take measures, for example, to close the lid 56 as measures to recover the suppressed output.

In a case where the opening 50*h* of the storage box 50 opens orthogonally to the up-down direction in the small planing watercraft 10, the object 8 inside the storage box 50 is likely to fall out, and ingress of water into the storage box 50 is likely to occur. A configuration to determine opening of the lid 56 is thus effective in a case where the opening 50*h* of the storage box 50 opens orthogonally to the up-down direction.

Assuming planing with the opening 50*h* of the storage box 50 being open, ingress of water into the storage box 50 is likely to occur due to waves in a case where the opening 50*h* of the storage box 50 is located forward of the handle 22 than in a case where the opening 50*h* of the storage box 50 is located rearward of the handle 22. Ingress of water is thus likely to be suppressed by determining whether the lid 56 is open in a case where the opening 50*h* of the storage box 50 is located forward of the handle 22. In a case where the opening 50*h* of the storage box 50 is located forward of the handle 22, the open or closed state of the lid 56 can be viewed over the handle 22.

Whether the lid 56 is open is determined based on the result of detection of the opening and closing sensor 59 when it is determined that the travel drive source 31 is started, so that whether the lid 56 is open is determined from an early stage of the start of travel. Since whether the lid 56 is open is determined immediately after the start of the travel drive source 31, ingress of water into the storage box 50 and a fall of the object 8 out of the storage box 50 are more surely suppressed.

The opening and closing sensor 59 is the contact sensor detecting contact between the lid 56 and the opening 50*h*, so that opening of the lid 56 can be detected by contact.

Ingress of water into the storage box 50 can be prevented by the lid 56 having the outer surface 56*f* as a portion of the outer surface of the body 12.

The small planing watercraft 10 includes the seat 18 straddled by the operator P, and the body 12 is turnable while rolling, so that the object 8 inside the storage box 50 is likely to fall out if the storage box 50 is open when the body 12 rolls. By determining whether the lid 56 is open when the body 12 rolls as described above, a fall of the object 8 is easily prevented.

Second Embodiment

Figure 7:
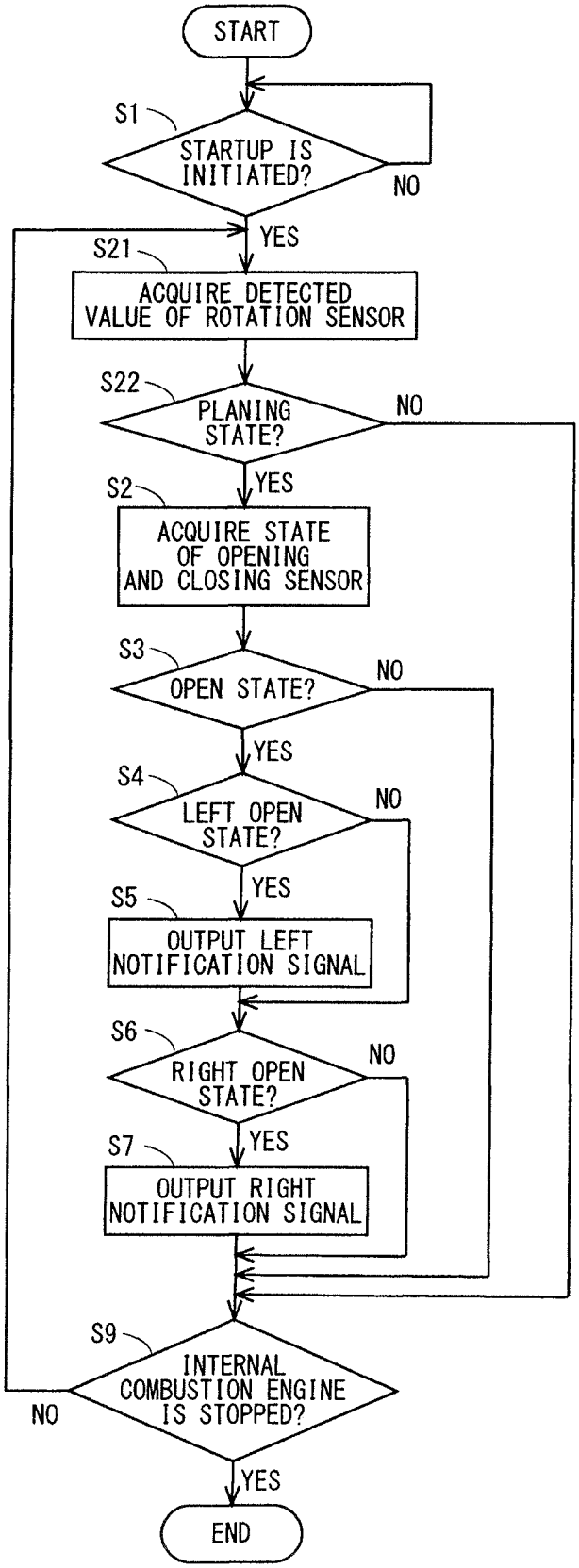
FIG. 7 is a flowchart showing an example of processing of a control device in a second embodiment.

A small planing watercraft 10 and a processing method for the small planing watercraft 10 in a second embodiment will be described below. FIG. 7 is a flowchart showing an example of processing of a control device in the second embodiment. Differences from processing in the above-mentioned first embodiment will mainly be described.

Steps S1 to S7 and S9 are the same as steps S1 to S7 and S9 in the first embodiment except for the following points.

That is to say, step S8 in the first embodiment is omitted. Processing thus proceeds to step S9 after step S7. Step S10 in the first embodiment is also omitted. Processing thus proceeds to step S9 when it is determined that the lid 56 is not open in step S3. In the second embodiment, processing in steps S8 and S10 may be performed as in the first embodiment.

Steps S21 and S22 to determine whether the small planing watercraft 10 has transitioned to the planing state are added between steps S1 and S2.

Processing proceeds to step S21 when it is determined that the travel drive source 31 is started in step S1. A detected value of the rotation sensor 31*a* is acquired in step S21.

In next step S22, whether the small planing watercraft 10 has transitioned to the planing state is determined based on rpm of the travel drive source 31 based on the result of detection of the rotation sensor 31*a*. Rpm of the travel drive source 31 has a positive correlation with the speed of the small planing watercraft 10, and the speed of the small planing watercraft 10 can be considered to be the speed in the planing state of the small planing watercraft 10 when rpm of the travel drive source 31 exceeds a predetermined threshold. When rpm of the travel drive source 31 is the same as the predetermined threshold, it may or may not be determined that the small planing watercraft 10 is in the planing state. Whether the small planing watercraft 10 is in the planing state may be determined based on the speed detected by the speed sensor.

Processing proceeds to step S2 when it is determined that the small planing watercraft 10 is in the planing state in step S22, and proceeds to step S9 when it is determined that the small planing watercraft 10 is not in the planing state in step S22.

Due to addition of steps S21 and S22 described above, processing returns not to step S2 but to step S21 when it is determined that the internal combustion engine is stopped in step S9. Thus, at all times during operation of the travel drive source 31 of the small planing watercraft 10, whether the small planing watercraft 10 is in the planing state is determined, and, when it is determined that the small planing watercraft 10 is in the planing state, whether the lid 56 is open is determined based on the result of detection of the opening and closing sensor 59.

According to the second embodiment, an effect similar to the effect obtained in the above-mentioned first embodiment can be obtained except for the effect obtained by setting of the mode. In addition, whether the lid is open is determined at transition to the planing state. Operation to provide notification that the lid 56 is open and the like can be performed in the planing state in which a fall of the object 8 out of the storage box 50 and ingress of water into the storage box 50 are more likely to occur than in a non-planing state.

MODIFICATIONS

An example in which the storage boxes 50 and the lids 56 are disposed in the opposite side portions of the front 14*a* is shown in the above-mentioned embodiments. The positions of the storage boxes and the lids are not limited to those in the above-mentioned example. For example, each of the storage boxes and the lids may be disposed in a central portion along the width of a front portion of the front, in a side or rear portion of the central protrusion 14*b*, in the side floors 14*c*, or in the rear floor 14*d*.

The opening and closing sensor 59 may not be the contact sensor described in the embodiments. The opening and closing sensor may be an optical sensor detecting opening and closing of the lid 56 depending on whether there is a shield for detected light in response to the open or closed state of the lid 56. The opening and closing sensor may be a magnetic sensor detecting a magnetic substance attached to the lid 56. The opening and closing sensor may be an angle sensor detecting an opening and closing angle of the hinge 58. In a case where a latch locking the lid 56 in the closed state is assembled to the opening 50*h* or the lid 56, the opening and closing sensor may be a sensor detecting a posture of the latch in which the lid is locked in the closed state. That is to say, the opening and closing sensor may be any sensor detecting the open or closed state of the lid 56 depending on the position or movement of the lid 56 relative to the opening 50*h* or a state of each component synchronized with the position or movement.

In the above-mentioned embodiments, whether the small planing watercraft 10 is in the planing state is determined by rpm detected by the rotation sensor 31*a*. Whether the small planing watercraft 10 is in the planing state may be determined based on output of another sensor. For example, the small planing watercraft 10 is considered to be in the planing state as the speed of the small planing watercraft 10 increases. Thus, in a case where the small planing watercraft 10 includes the speed sensor, whether the small planing watercraft 10 is in the planing state may be determined based on output of the speed sensor. The small planing watercraft 10 is considered to be in an upward inclined posture when the small planing watercraft 10 is in the planing state. Thus, in a case where the small planing watercraft 10 includes a trim angle sensor detecting the trim angle around a pitch axis, whether the small planing watercraft 10 is in the planing state may be determined based on output of the trim angle sensor.

An example in which the display device 48 is the notification device providing notification that the lid 56 is open is described in the above-mentioned embodiments. The notification device may not be a notification device visually providing notification. For example, the notification device may be a notification device providing notification using a sounding body emitting a buzzer sound or a notification voice.

In the first embodiment, both the processing to provide notification as in steps S5 and S7 and the processing to change the mode as in steps S9 and S10 may not necessarily be performed, and only one of them may be performed. Similarly, in the second embodiment, in addition to or in place of the processing to provide notification as in steps S5 and S7, the processing to change the mode as in steps S9 and S10 may be performed.

Configurations described in the above-mentioned embodiments and modifications can be combined with each other as appropriate unless any contradiction occurs.

<Additional Remark>

The functionality of the elements disclosed herein may be implemented using circuitry or processing circuitry which includes general purpose processors, special purpose processors, integrated circuits, ASICs ("Application Specific Integrated Circuits"), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The present application discloses the following aspects.

A first aspect is a small planing watercraft including: a body including a storage box and a lid, the storage box including an opening, the lid releasably closing the opening; an opening and closing sensor detecting opening and closing of the lid; and processing circuitry determining whether the lid is open based on a result of detection of the opening and closing sensor, and, when determining that the lid is open, outputting a signal indicating that the lid is open.

According to the first aspect, notification to an operator, control of travel, or the like can be provided based on the signal indicating that the lid is open.

A second aspect is the small planing watercraft according to the first aspect further including a notification device, wherein, when determining that the lid is open, the processing circuitry causes the notification device to provide notification that the lid is open.

As described above, the notification device can notify a user that the lid is open.

A third aspect is the small planing watercraft according to the second aspect, wherein the storage box of the body includes storage boxes, and the lid of the body includes lids, and, when determining that the lid is open, the processing circuitry identifies one or more of the lids that are open, and causes the notification device to provide notification that the identified lids are open.

The user can thus know the one or more of the lids that are open.

A fourth aspect is the small planing watercraft according to the first aspect, wherein a travel mode of the small planing watercraft is switchable between a first travel mode and a second travel mode in which output is suppressed relative to the first travel mode, and, when determining that the lid is open, the processing circuitry sets the travel mode to the second travel mode.

In this case, the small planing watercraft can travel with output being suppressed as defined in the second travel mode when the lid is open. Ingress of water into the storage box and a fall of an object out of the storage box are thus suppressed.

A fifth aspect is the small planing watercraft according to the first aspect further including a notification device, wherein a travel mode of the small planing watercraft is switchable between a first travel mode and a second travel mode in which output is suppressed relative to the first travel mode, and, when determining that the lid is open, the processing circuitry causes the notification device to provide notification that the lid is open, and sets the travel mode to the second travel mode.

In this case, the small planing watercraft can travel with output being suppressed as defined in the second travel mode when the lid is open. Ingress of water into the storage box and the fall of the object out of the storage box are thus suppressed. Furthermore, the user can understand that the travel mode is set to the second travel mode because the lid is open. The user can thus easily take measures to recover the suppressed output.

A sixth aspect is the small planing watercraft according to the first aspect, wherein the opening of the storage box opens orthogonally to an up-down direction.

Notification to the operator, control of travel, or the like can thus be provided when ingress of water into the storage box from the side and a fall out of the object are likely to occur.

A seventh aspect is the small planing watercraft according to the first aspect further including a handle supported on the body, wherein the opening of the storage box is located forward of the handle.

Assuming planing with the opening of the storage box being open, ingress of water into the storage is likely to occur due to waves in a case where the opening of the storage box is located forward of the handle than in a case where the storage box is formed at a position rearward of the handle. Ingress of water is thus likely to be suppressed by outputting the signal indicating that the lid is open in a case where the storage box into which ingress of water is likely to occur as described above is provided.

An eighth aspect is the small planing watercraft according to the first aspect further including a drive source generating propulsion power as a travel drive source, wherein, when it is determined that the drive source is started, the processing circuitry determines whether the lid is open based on the result of detection of the opening and closing sensor.

Whether the lid is open is thus determined when an internal combustion engine is started.

A ninth aspect is the small planing watercraft according to the first aspect further including a drive source generating propulsion power as a travel drive source, wherein, when it is determined that the small planing watercraft transitions to a planing state, the processing circuitry determines whether the lid is open based on the result of detection of the opening and closing sensor.

Whether the lid is open is thus determined at transition to the planing state in which a fall of the object out of the storage box and ingress of water into the storage box are likely to occur.

A tenth aspect is the small planing watercraft according to the first aspect, wherein the opening and closing sensor is a contact sensor detecting contact between the lid and the opening.

In this case, opening of the lid can be detected by contact.

An eleventh aspect is the small planing watercraft according to the first aspect, wherein an outer surface of the lid is a portion of an outer surface of the body.

In this case, ingress of water into the storage box can be prevented by the lid having the outer surface as the portion of the outer surface of the body.

A twelfth aspect is the small planing watercraft according to the first aspect further including a seat straddled by the operator, wherein the body is turnable while rolling.

The object inside the storage box is likely to fall out if the storage box is open when the body rolls. By providing the opening and closing sensor to the body, the fall of the object is easily prevented.

A thirteenth aspect is a processing method for a small planing watercraft including a storage box and a lid, the storage box including an opening, the lid releasably closing the opening, the processing method including: detecting opening and closing of the lid; determining whether the lid is open based on a result of detection; and, when determining that the lid is open, setting a travel mode to a second travel mode in which output is suppressed relative to a first travel mode.

Ingress of water into the storage box and the fall of the object out of the storage box are thus suppressed.

A fourteenth aspect is a processing method for a small planing watercraft including a storage box and a lid, the storage box including an opening, the lid releasably closing the opening, the processing method including: detecting opening and closing of the lid; determining whether the lid is open based on a result of detection; and, when determining that the lid is open, providing notification that the lid is open.

The operator can thus be notified that the lid is open.

The foregoing description is in all aspects illustrative and not restrictive. It is therefore understood that numerous unillustrated modifications can be devised without departing from the scope of the invention.

What is claimed is:

1. A personal watercraft comprising:

a body including a storage box and a lid, the storage box including an opening, the lid releasably closing the opening;

an opening and closing sensor detecting opening and closing of the lid; and processing circuitry determining whether the lid is open based on a result of detection of the opening and closing sensor, and when determining that the lid is open, outputting a signal indicating that the lid is open; and a drive source generating propulsion power as a travel drive source;

wherein a travel mode of the personal watercraft is switchable between a first travel mode and a second travel mode in which output of the drive source is suppressed relative to the first travel mode, and, when determining that the lid is open, the processing circuitry sets the travel mode to the second travel mode.

2. The personal watercraft according to claim 1 further comprising a notification device, wherein when determining that the lid is open, the processing circuitry causes the notification device to provide notification that the lid is open.

3. The personal watercraft according to claim 2, wherein the storage box of the body comprises storage boxes, and the lid of the body comprises lids, and when determining that the lid is open, the processing circuitry identifies one or more of the lids that are open, and causes the notification device to provide notification that the identified one or more lids are open.

4. The personal watercraft according to claim 1 further comprising a notification device, wherein a travel mode of the personal watercraft is switchable between a first travel mode and a second travel mode in which output is suppressed relative to the first travel mode, and, when determining that the lid is open, the processing circuitry causes the notification device to provide notification that the lid is open, and sets the travel mode to the second travel mode.

5. The personal watercraft according to claim 1, wherein the opening of the storage box opens orthogonally to an up-down direction.

6. The personal watercraft according to claim 1 further comprising a handle supported on the body, wherein the opening of the storage box is located forward of the handle.

7. The personal watercraft according to claim 1 further comprising a drive source generating propulsion power as a travel drive source, wherein when the drive source is started, the processing circuitry determines whether the lid is open based on the result of detection of the opening and closing sensor.

8. The personal watercraft according to claim 1, wherein the opening and closing sensor is a contact sensor detecting contact between the lid and the opening.

9. The personal watercraft according to claim 1, wherein an outer surface of the lid is a portion of an outer surface of the body.

10. The personal watercraft according to claim 1 further comprising a seat straddled by an operator, wherein the body is turnable while rolling.

11. A personal watercraft comprising a body including a storage box and a lid, the storage box including an opening, the lid releasably closing the opening;

an opening and closing sensor detecting opening and closing of the lid; and processing circuitry determining whether the lid is open based on a result of detection of the opening and closing sensor, and when determining that the lid is open, outputting a signal indicating that the lid is open; and a drive source generating propulsion power as a travel drive source, wherein when the personal watercraft transitions to a planing state, the processing circuitry determines whether the lid is open based on the result of detection of the opening and closing sensor.

12. A personal watercraft comprising:

a body including a storage box and a lid, the storage box including an opening, the lid releasably closing the opening;

an opening and closing sensor detecting opening and closing of the lid; and processing circuitry determining whether the lid is open based on a result of detection of the opening and closing sensor, and when determining that the lid is open, outputting a signal indicating that the lid is open;

a drive source generating propulsion power as a travel drive source, wherein when the personal watercraft transitions to a planing state, the processing circuity determines whether the lid is open based on the result of detection of the opening and closing sensor; and a display device displaying travel information or oil level, wherein information indicating a lid open state is displayed in a display screen of the display devices.

13. The personal watercraft according to claim 12, wherein the lid includes a right lid and a left lid, and the display screen displays information indicating an open state of the right and left lids.

14. The personal watercraft according to claim 12, wherein the lid includes a right lid and a left lid, and the display screen displays independently an open state of each of the right and left lids.

* * * * *